US010900396B2

(12) United States Patent
Ayesh et al.

(10) Patent No.: US 10,900,396 B2
(45) Date of Patent: Jan. 26, 2021

(54) EXHAUST ORIFICE TUBE FOR VEHICLE MUFFLERS

(71) Applicant: Ford Global Technologies, LLC, Dearborn, MI (US)

(72) Inventors: Hani Mohammad Ayesh, Canton, MI (US); Kerry Timothy Havener, Canton, MI (US); Shawn David Norman, Grass Lake, MI (US); Steven A. Hornby, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 442 days.

(21) Appl. No.: 15/871,766

(22) Filed: Jan. 15, 2018

(65) Prior Publication Data

US 2019/0218956 A1 Jul. 18, 2019

(51) Int. Cl.

| | |
|---|---|
| ***F01N 1/08*** | (2006.01) |
| ***F01N 13/04*** | (2010.01) |
| ***F01N 1/00*** | (2006.01) |

(52) U.S. Cl.

CPC ..... *F01N 1/084* (2013.01); *F01N 1/006* (2013.01); *F01N 1/083* (2013.01); *F01N 13/04* (2013.01); *F01N 2470/02* (2013.01); *F01N 2470/14* (2013.01); *F01N 2490/06* (2013.01)

(58) Field of Classification Search

CPC .. F01N 2470/02; F01N 2470/14; F01N 13/04; F01N 1/083; F01N 1/084; F01N 1/161; F01N 1/163; F01N 1/165; F01N 1/166; F01N 2490/06; F01N 1/006; F01N 2470/30

See application file for complete search history.

(56) References Cited

U.S. PATENT DOCUMENTS

| | | | | | |
|---|---|---|---|---|---|
| 3,672,464 | A * | 6/1972 | Rowley | F01N 1/003 | 181/253 |
| 4,203,503 | A | 5/1980 | Franco et al. | | |
| 4,209,076 | A | 6/1980 | Franco et al. | | |
| 4,267,899 | A * | 5/1981 | Wagner | F01N 1/003 | 181/272 |
| 4,361,206 | A * | 11/1982 | Tsai | F01N 1/08 | 181/255 |
| 4,368,799 | A * | 1/1983 | Wagner | F01N 1/00 | 181/255 |
| 4,501,341 | A * | 2/1985 | Jones | F01N 1/006 | 181/250 |

(Continued)

FOREIGN PATENT DOCUMENTS

| | | | | |
|---|---|---|---|---|
| CN | 2380690 Y | 5/2000 | | |
| CN | 201539296 U | 8/2010 | | |
| JP | 2015121134 A * | 7/2015 | | F02D 35/023 |

*Primary Examiner* — Jeremy A Luks

(74) *Attorney, Agent, or Firm* — Geoffrey Brumbaugh; Brooks Kushman, P.C.

(57) ABSTRACT

A vehicle exhaust system is provided. The exhaust system may include a muffler including a casing, an inlet tube extending therethrough, and an outlet pipe partially disposed therein. The exhaust system may also include an orifice tube that may have a tapered body inserted within an end of the outlet pipe that is disposed between a baffle and a wall of the casing. The orifice tube may also include an inlet portion flared from the tapered body configured to attenuate noise of exhaust gas funneling into the outlet pipe.

11 Claims, 6 Drawing Sheets

(56) References Cited

U.S. PATENT DOCUMENTS

| | | | | | |
|---|---|---|---|---|---|
| 4,690,245 | A * | 9/1987 | Gregorich | F01N 1/003 | 138/40 |
| 5,025,890 | A * | 6/1991 | Hisashige | F01N 1/02 | 181/256 |
| 5,519,994 | A * | 5/1996 | Hill | F01N 1/00 | 181/238 |
| 5,602,368 | A * | 2/1997 | Kaneso | F01N 1/003 | 181/250 |
| 6,158,546 | A * | 12/2000 | Hanson | F01N 1/02 | 181/247 |
| 6,354,398 | B1 * | 3/2002 | Angelo | F01N 1/006 | 181/256 |
| 7,694,778 | B2 * | 4/2010 | Toyoshima | H01M 8/0662 | 181/268 |
| 7,866,442 | B2 * | 1/2011 | Shimomura | F01N 1/10 | 181/249 |
| 8,607,923 | B2 * | 12/2013 | Takagaki | F01N 1/02 | 181/249 |
| 8,806,859 | B2 * | 8/2014 | Komitsu | F01N 1/083 | 60/324 |
| 8,844,673 | B2 * | 9/2014 | Kainuma | F01N 1/081 | 181/265 |
| 2011/0127105 | A1 * | 6/2011 | Lim | F01N 1/023 | 181/212 |

* cited by examiner

EXHAUST ORIFICE TUBE FOR VEHICLE MUFFLERS

TECHNICAL FIELD

The present disclosure generally relates to a vehicle exhaust system and more specifically, an interface between an inlet pipe and a muffler.

BACKGROUND

Vehicles, in particular those vehicles equipped with an internal combustion engine, often include an exhaust system used to guide exhaust gases away from the internal combustion to a desired outlet. The exhaust system may include one or more exhaust pipes connected to a manifold or header that extend to a muffler. Mufflers often serve as an acoustic sound attenuating device designed to reduce the loudness of the sound pressure created by the engine. Typically, mufflers receive the exhaust gases from an inlet pipe and expel the gas through an outlet pipe or tailpipe.

Active exhaust systems may include a muffler that includes one or more pipes and one or more valves that may be opened or closed to alter the acoustic characteristics of the exhaust.

SUMMARY

According to one embodiment of this disclosure, a vehicle exhaust system is provided. The exhaust system may include a muffler including a casing, an inlet tube extending therethrough, and an outlet pipe partially disposed therein. The exhaust system may also include an orifice tube that may have a tapered body inserted within an end of the outlet pipe that is disposed between a baffle and a wall of the casing. The orifice tube may also include an inlet portion flared from the tapered body configured to attenuate noise of exhaust gas funneling into the outlet pipe.

According to another embodiment of this disclosure, a vehicle exhaust system is provided. The exhaust system may include a muffler including a casing, an inlet tube extending therethrough, and an outlet pipe partially disposed within the casing. The exhaust system may also include a funnel that may include an inlet portion, an outlet portion, and a flared portion extending therebetween. The flared portion may be configured to mitigate sound pressure of exhaust gas flowing from the inlet portion into the outlet pipe.

According to yet another embodiment of this disclosure, a vehicle muffler assembly is provided. The muffler assembly may include a casing, a perforated inlet tube extending therethrough, and an outlet pipe partially disposed within the case. The muffler assembly may also include a pipe reducer that includes a tapered body that is inserted within an end of the outlet pipe that is disposed between a baffle and a wall of the casing, and inlet portion flared from the tapered body configured to attenuate noise of exhaust gas funneling into the outlet pipe.

Figure 1:
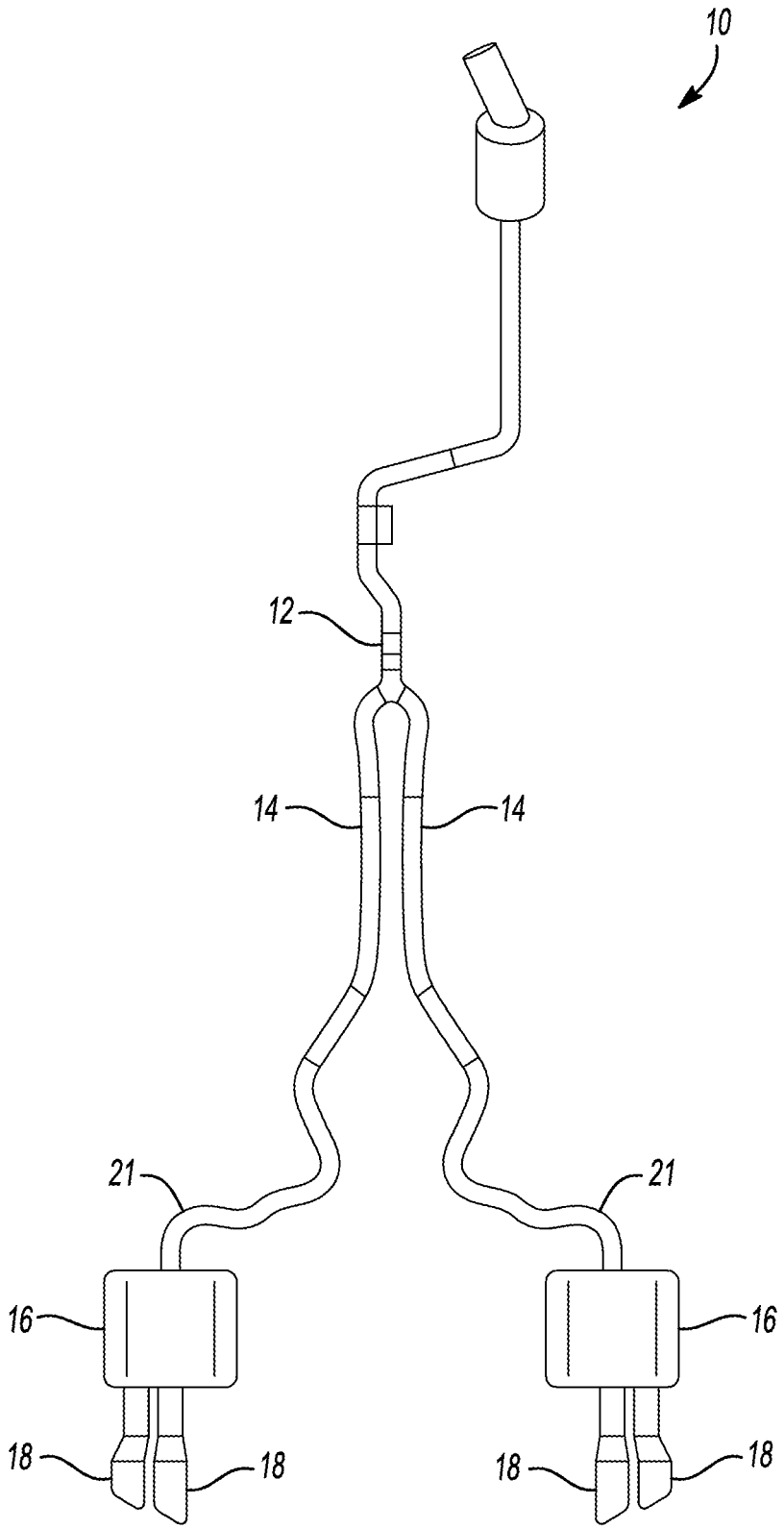
FIG. 1 is a top view of an exemplary exhaust system.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Vehicle exhaust systems often employ a muffler to reduce and control loudness (measured in decibels) of sound pressure created by the exhaust gas of the engine. The muffler includes a casing, an inlet pipe, (e.g. tube, cylinder, passage) and an outlet pipe (e.g. tube, cylinder, passage). The inlet pipe is fluidly connected to the engine and facilitates flow of exhaust gas to the muffler casing. A portion or first end of the tail pipe is disposed within the casing and a second end extends out of the muffler. The muffler may further include one or more baffles or plates that divide the muffler casing into multiple (e.g. first and second) chambers. FIGS. 2-5 each illustrate a two-chamber muffler casing. A muffler for an active exhaust system may include one or more valves that are operable to control the flow of gas between the first and second chambers or through the inlet and outlet pipes. Under certain circumstances, a lugging moan may occur as exhaust flows from the muffler casing into the outlet pipe. The lugging moan is caused by a Helmholtz mode created the geometry of the outlet pipe and volume of the muffler casing.

Helmholtz mode or resonance refers to a phenomenon of air resonance in a cavity, as when one blows air across the top of an empty bottle to create a noise. This resonance is a function of the volume of the bottle, a length of the neck of the bottle, and the cross-sectional area of the neck. As it relates to the muffler assembly, Helmholtz resonance is function of the volume of the first chamber, where the inlet portion of the outlet pipe is located, the diameter of the outlet pipe, and the distance between the inlet (e.g. proximal) end and the outlet (e.g. distal) end.

The lugging moan may be reduced by impeding the sound waves of the exhaust gas as it travels from the first chamber through outlet pipe. Reducing the diameter of the inlet end of the outlet pipe may increase the acoustic impedance. This reduction in diameter may be accomplished by an orifice plate disposed across a portion of the outlet pipe. However, the orifice plate abruptly reduces the flow area and results in flow separation—often associated with air rush or flow noise. Secondly, an orifice plate typically includes a stamped or punched hole that defines a sharp edge (e.g. 80-90°). The sharp edge leads to a turbulent flow of the exhaust gas, also associated with air rush or flow noise. Finally, the reduction in flow area through the orifice plate increases the flow velocity of the exhaust gas causing a pressure drop after the orifice plate, another contributor of air rush or flow noise.

To mitigate the lugging moan while containing or limiting the air rush noise, an orifice tube or funnel is used to alter the flow (e.g. pressure, acceleration, velocity, etc.) of the exhaust gas as it travels into the outlet pipe. The orifice tube may include a tapered body that is inserted into the inlet end of the outlet pipe. An inlet portion of the tapered body may be flared from the tapered body to control the flow and minimize the increase of air rush or flow noise of the exhaust gas as it flows through the outlet pipe.

Referring to FIG. 1, an exhaust assembly 10 that includes two mufflers 16 is illustrated. The exhaust assembly 10 includes an inlet pipe connected to a Y-splitter 12 that is connected to two I-pipes 14. Each of the I-pipes 14 extend to an inlet pipe 21 that continues into the muffler 16. The muffler 16 may include one or more outlet pipes or tailpipes 18. The exhaust assembly 10 may be actively controlled (e.g., active exhaust). Actively controlled exhaust assemblies include one or more valves actuated by a controller or processor. Opening or closing the valves alters the sound (e.g., sound pressure, frequency, etc.) of the exhaust as a user or operator sees fit.

Figure 2:
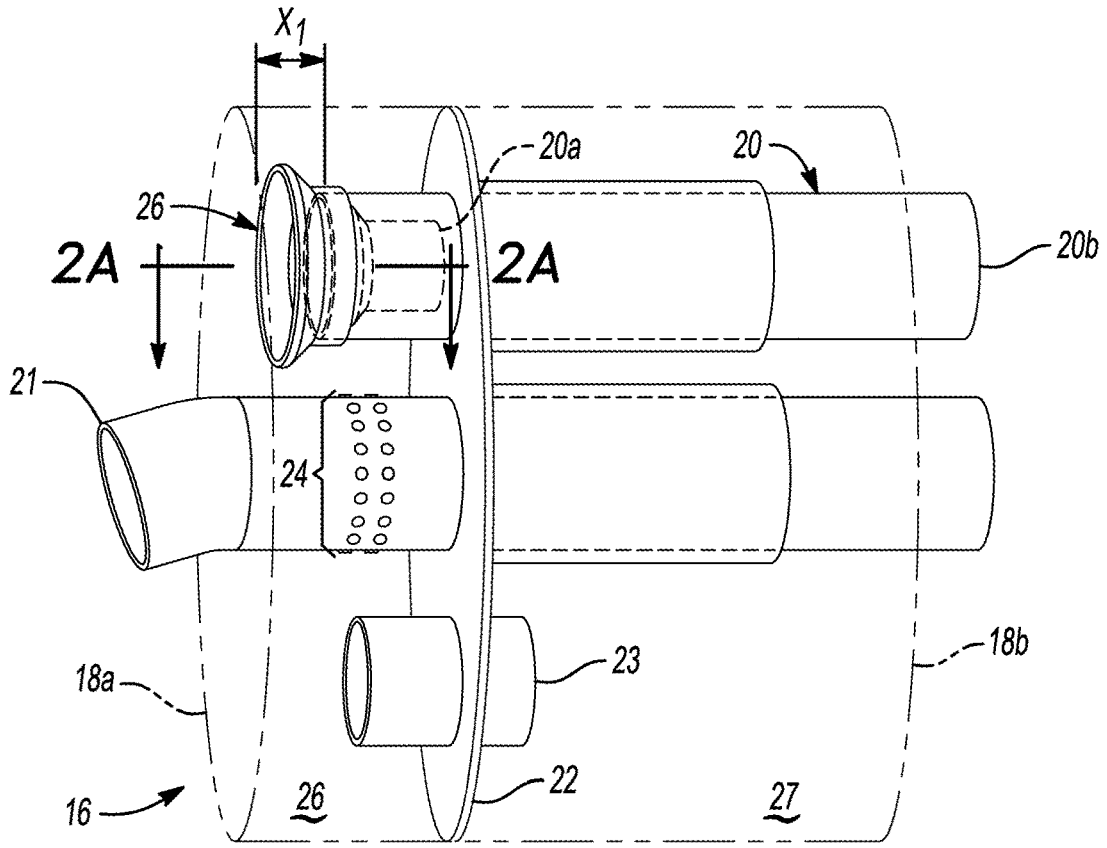
FIG. 2 is a top view of a muffler assembly according to a first embodiment.
Figure 2A:
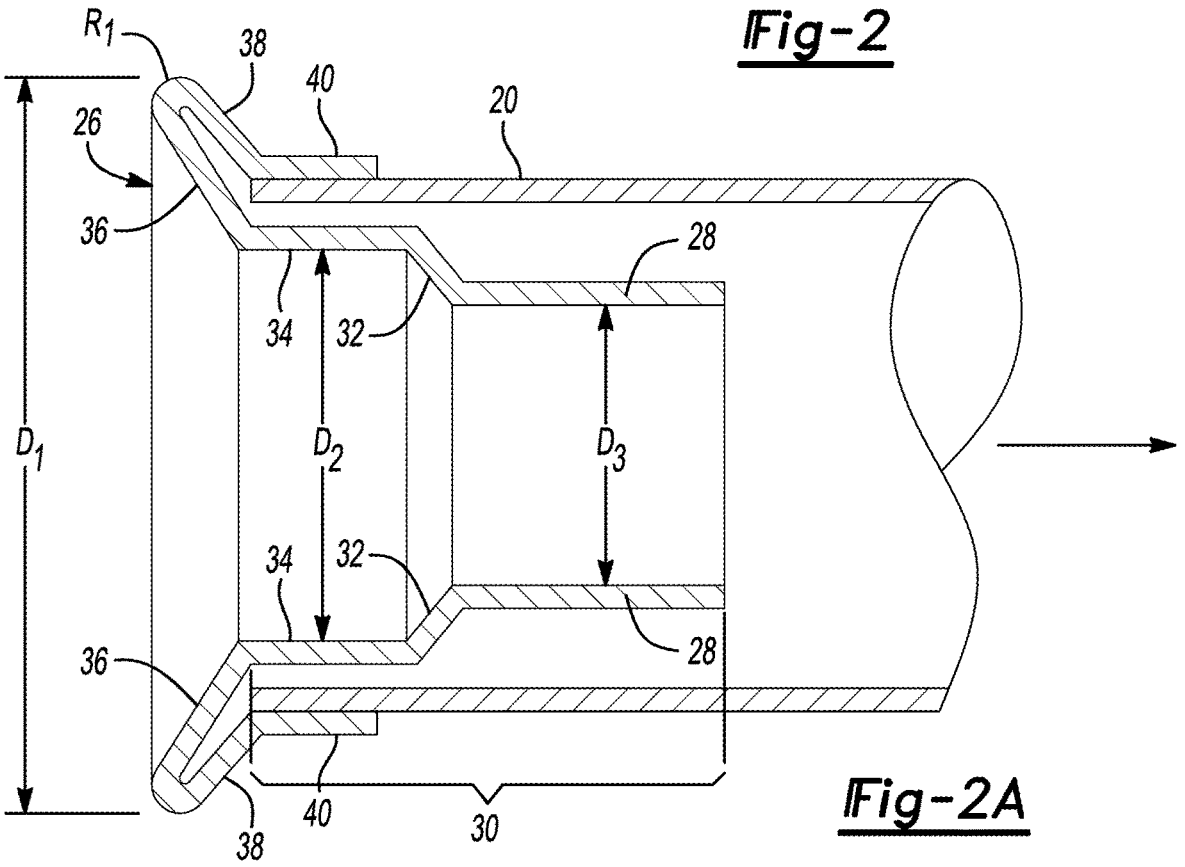
FIG. 2A is a cross-sectional view of a taken along the lines 2A in FIG. 2.

Referring to FIG. 2 and FIG. 2A, a muffler assembly 16 and orifice tube 26 is provided. The muffler assembly 16 includes a casing 17 that extends between a first wall 18*a* and a second wall 18*b*. A metal divider or plate, such as a baffle 22 bifurcates the casing 17 in to a first portion 26 and a second portion 27. A tuner, such as a Helmholtz tuner 23 is disposed within the casing 17 and extends through the baffle 22. The tuner 23 may alter the acoustic performance of the muffler 16. The inlet tube 21 extends from the I-pipe 14 (FIG. 1) through the first wall 18*a*, through the baffle 22, and through the second wall 18*b*. A valve (not illustrated) may be disposed within the second portion 27 of the inlet pipe 21 between the baffle 22 and the second wall 18*b*. Alternatively, a valve may be disposed within the tail pipe 18 so that it is external to the muffler. The valve may be opened, closed or rotated to a position between the open and closed positions to alter the acoustic performance of the muffler. A portion of the inlet tube 21 that is disposed within the first portion 26 of the casing 17 includes apertures or perforations 24 to allow the exhaust gas to exit the inlet tube 21. A portion of the inlet tube 21, disposed within the second portion 27 of the casing 17, includes apertures or perforations to reduce air rush or flow noise sound pressure before the exhaust gas exits the muffler.

The muffler assembly 16 further includes an outlet pipe 20 and an orifice tube 26 assembled therein. The outlet pipe 20 includes a first end 20*a* disposed within the first portion of the casing 26 and a second end 20*b* that extends through the second wall 18*b*. The first end 20*a* of the orifice tube 20 is spaced apart from the first wall 18*a* of the muffler 16 by a distance X1. The orifice tube 26 is assembled to and inserted within the first end 20*a* of the outlet pipe 20. As exhaust gas flows through the inlet pipe 21, with or without the one or more valves mentioned above closed or opened, it exits the apertures or perforations 24 into the first portion 26. The exhaust gas then travels through the orifice tube 26 through the outlet pipe 20 from the first end 20*a* to the second end 20*b*.

As mentioned above, without the orifice tube 26 the sound pressure of the lugging moan or noise may be unacceptable. The lugging noise is particularly noticeable when the engine reaches speeds between 1,000 rpm and 2,500 rpm.

Now referring specifically to FIG. 2A, a partial-cross-sectional view of the outlet pipe 20 and the orifice tube 26, is illustrated. The orifice tube 26 includes a flared portion 36 that angles away from the outlet pipe 20 to define an inner diameter D1. The flared portion 36 extends from a body, such as a nozzle or tapered body 30, that includes a medial portion 34 that is disposed within the outlet pipe 20. The medial portion 34 defines an inner diameter D2 that is less than the inner diameter D1 of the flared portion 36. A transition portion 32 extends between the medial portion to a distal end portion 28. The distal end portion 28 defines an inner diameter D3 that is smaller than the inner diameter D2. The orifice tube diameter decreases further between the medial portion 34 and the distal portion 28 with respect to the flared portion 36.

The reduction in diameter between the inner diameter D1 of the flared portion 36, the inner diameter D2 of the medial portion 34, and the inner diameter D3 of the distal end portion attenuates overall sound levels and lugging moan or noise. The decreasing diameter impedes the sound waves traveling through orifice tube 26 and in turn the outlet pipe 20. Moreover, decreasing the diameter (e.g., D1, D2, and D3) increases the expansion volume of the pipe causing an increase in reflection of the sound waves. Increase in reflection of the sound waves may attenuate the sound levels. Naturally, the overall reduction in diameter of the orifice tube 26 results in a reduction of the cross-sectional area. When the cross-sectional area of the Helmholtz neck (e.g. orifice tube 26) is reduced, the frequency of the sound waves traveling through the neck is reduced.

The flared portion 36 and the tapered body 30 are each configured to minimize flow noise or air rush noise. The flared portion 36 may remove or reduce flow separation of the exhaust gas before it enters the tapered body 30. The tapered body allows the flow velocity to stabilize gradually to reduce turbulence of the traveling gas. Finally, drop in pressure as the gas exits the orifice tube is more gradual as compared to an orifice plate (FIG. 1).

The orifice tube 26 may also include a flange 38 that extends from the flared portion 36. The flange 38 may be folded back towards the flared portion 36 to define a radius $R_1$. The flange 38 may also include a connecting end 40 that is formed to lie against the outer portion of the outlet pipe when the orifice is assembled to the outlet pipe 20. The connecting end 40 may be attached to the outlet pipe 20 by one or more welds or a structural adhesive. In another embodiment, the medial portion 34 and the connecting end 40 may sandwich the outlet pipe to connect the orifice tube to the outlet pipe by a force fit condition.

In another embodiment, the body or nozzle 30 of the orifice tube 26 may have a constant diameter. More specifically, the medial portion and inner diameter D2 extend along the length of the body. Alternatively, the body or nozzle may be further tapered than the body 30 illustrated in FIG. 2A.

In yet another embodiment, the medial portion 34 of the orifice tube 26 is disposed along the inner wall of the outlet pipe 20. In this embodiment, the orifice assembly 26 is not attached to the connecting end 40. Rather, the medial portion 34 is attached to the inner tube by one more welds or a structural adhesive.

The following discussion of FIG. 3 through FIG. 5A describe additional embodiments. Some of the elements of the additional embodiments are common with the first embodiment described above. Those common elements have the same characteristics and functions as the elements of the first embodiment, so the description of those elements above applies to the description of the additional embodiment discussed below.

Figure 3:
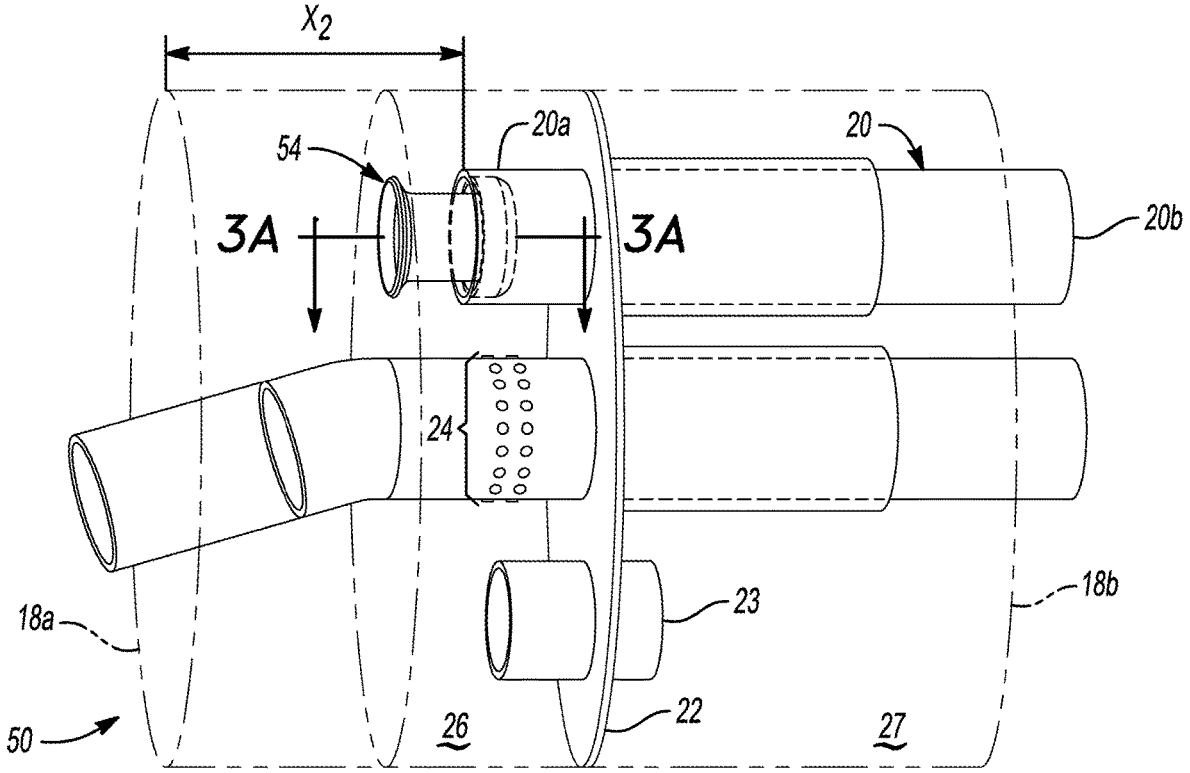
FIG. 3 is a top view of a muffler assembly according to a second embodiment.
Figure 3A:
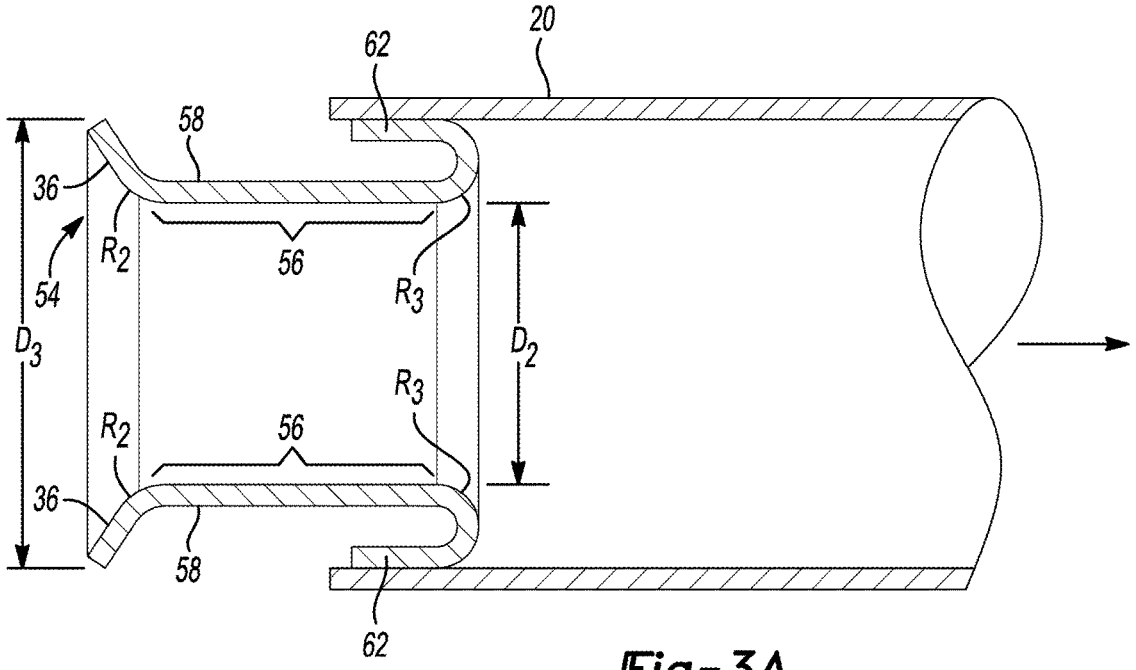
FIG. 3A is a cross-sectional view of a taken along the lines 3A in FIG. 3.

Referring to FIG. 3 and FIG. 3A, a muffler assembly 50 including an orifice tube 54 according to a second embodiment is provided. In this embodiment, the casing 52 is longer than the casing 17 described in FIG. 2. Moreover, the orifice tube 54 itself is longer to provide additional order control of the acoustics associated with the flow of exhaust gas through the muffler assembly 50. Because the casing 52 is longer than the casing 17, the first end 20*a* of the outlet pipe 20 is spaced apart from the first wall 18*a* by a distance X2. The distance X2 is greater than the distance X1 illustrated in FIG. 2. The orifice tube 54 includes the flared portion 36 that defines an inner diameter D3. The flared portion 36 includes a radius $R_2$ and defines an inner diameter D3. A body 56 extends from the flared portion 36 to a folded end 60. The folded end defines a third radius $R_3$ that extends between the body 56 to a connecting end 62. Each of the radii $R_2$ and $R_3$, decrease the air rush noise of the exhaust gas moving from the first portion 26 through the second portion 27.

Figure 4:
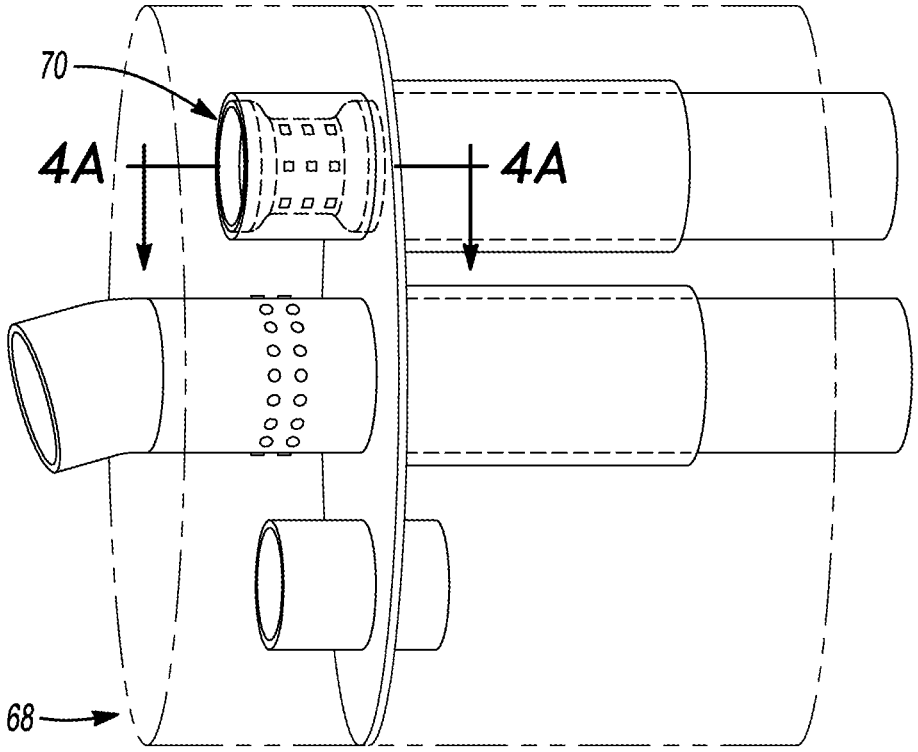
FIG. 4 is a top view of a muffler assembly according to a third embodiment.
Figure 4A:
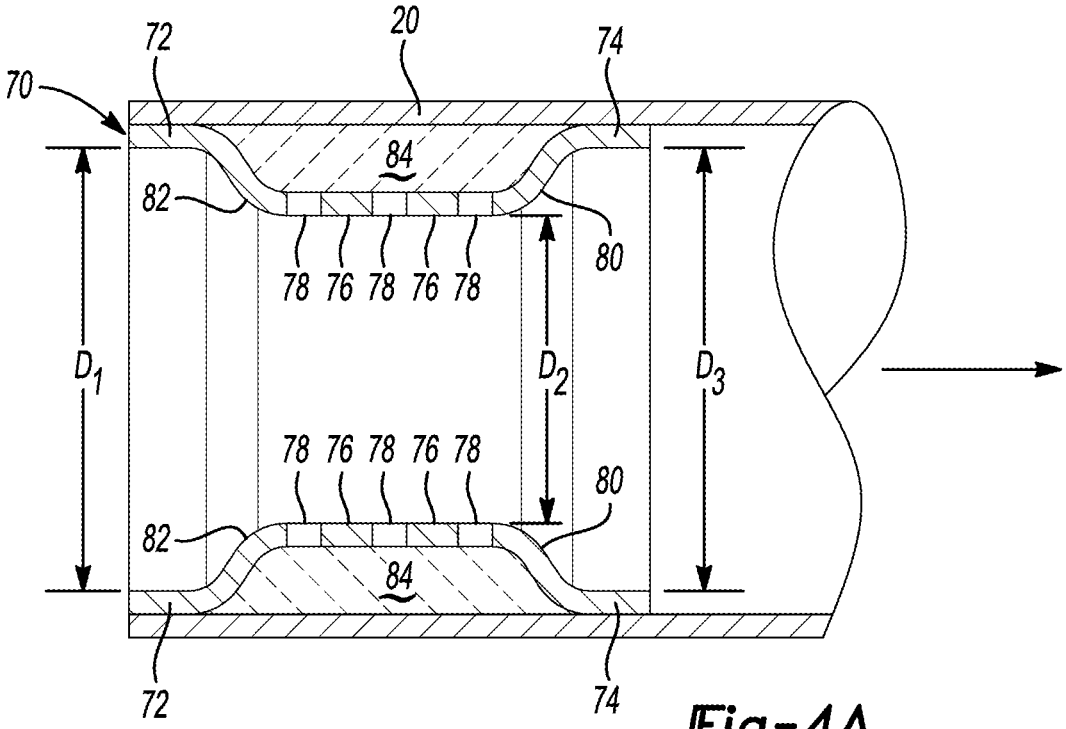
FIG. 4A is a cross-sectional view taken along the lines 4A in FIG. 4.

Referring to FIG. 4 and FIG. 4A, a muffler assembly 68 including an orifice tube 70 according to a third embodiment of this disclosure is provided. The orifice tube 70 may be configured to contain or hold packing, such as e-glass 84, against the outlet pipe 20. The e-glass 84 may absorb or deaden the noise of the exhaust gas (e.g., air rush noise, lugging noise, etc.) as it flows through the orifice tube 70. The orifice tube 70 include inlet connecting walls 72 that are disposed along the inner wall of the outlet pipe and are adjacent to the first end 20*a* of the outlet pipe. The orifice tube 70 also include inlet flange portions 82 that extend from the inlet connecting wall 72 to a medial wall 76. The inlet connecting wall defines a diameter D1 and the medial wall 76 defines a diameter D2 that is smaller than the diameter D1. The distal connecting wall defines a third diameter D3 that may be approximately equal to the diameter D1. The various diameters D1, D2, and D3 define a passage way. The volume of the passageway decreases between D1 and D2 to promote a controlled flow of the exhaust gas as it enters and moves through the orifice tube 70. The pressure of the exhaust gas is at its highest when it is disposed within the medial wall. This pressure acts on the exhaust gas so that it displaced towards the packing or e-glass 84. The volume of the passageway gradually increases between the medial wall and the distal wall 74. The gradual increase promotes a controlled flow of the exhaust gas as it moves through the orifice tube 70 and enters the outlet pipe 20. Again, the controlled flow in and out of the orifice tube 70 may decrease the sound pressure associated with the flow of the exhaust gas within the muffler assembly.

The medial wall 76 includes one or more apertures or perforations 78. Sound waves of the exhaust gas travel through the perforations 78 to the e-glass material 84. The orifice tube further includes distal flange portions 80 that extend from the medial portions to distal connecting members 74. The distal connecting members 74 and the inlet connecting members 72 may be attached to the outlet pipe 20 by one or more welds or a structural adhesive.

Figure 5:
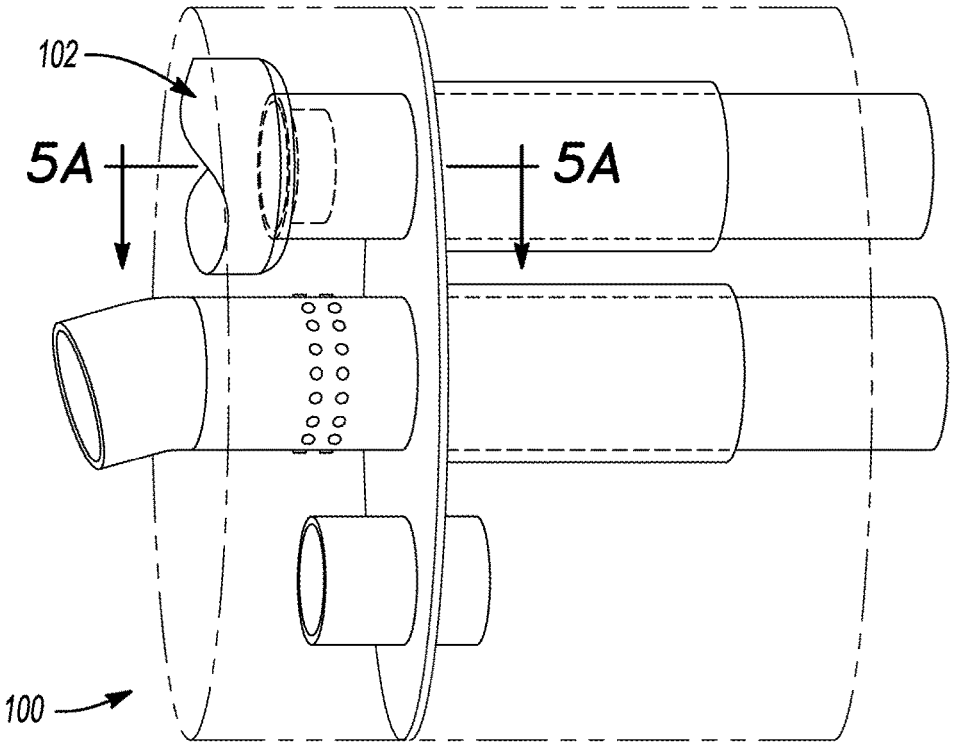
FIG. 5 is a top view of a muffler assembly according to a fourth embodiment.
Figure 5A:
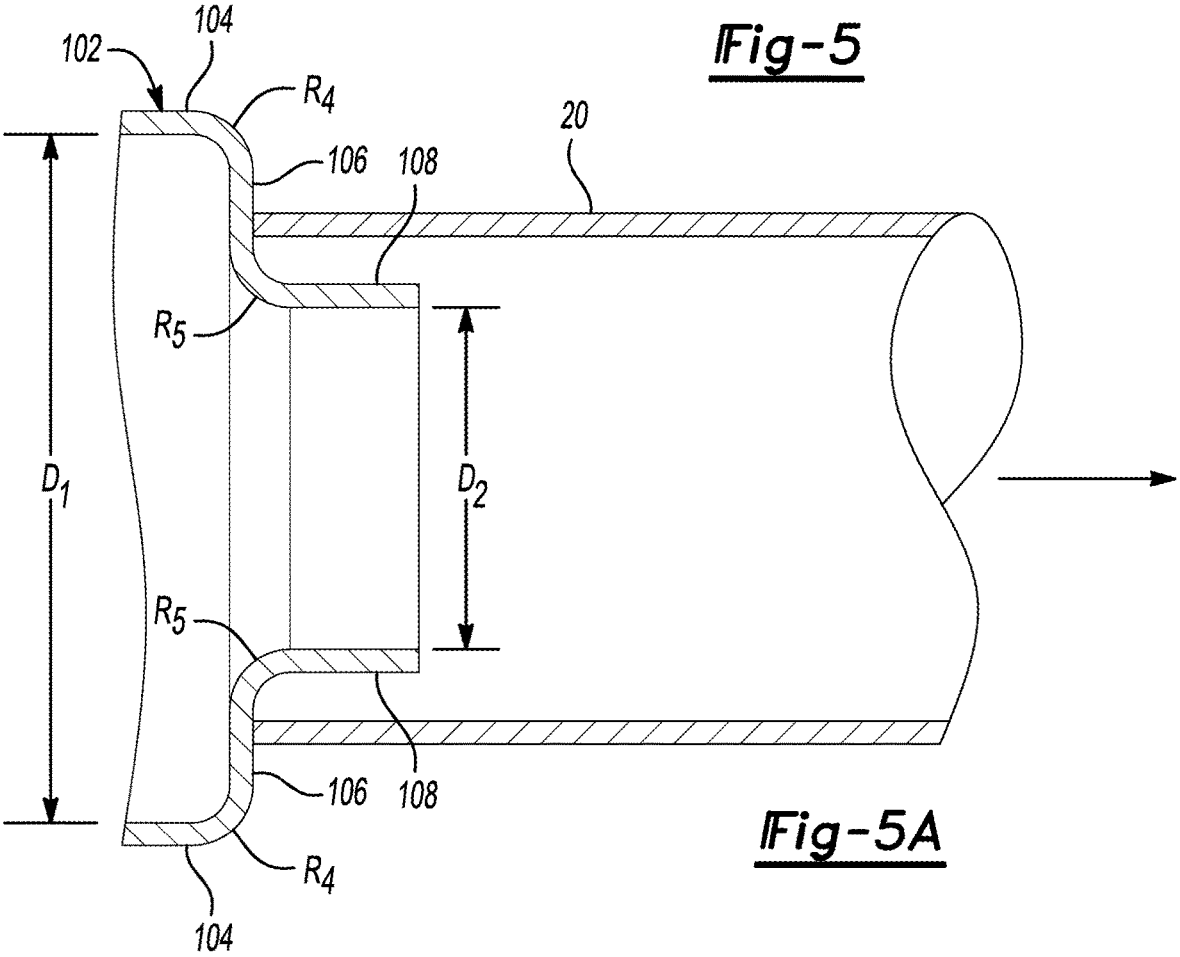
FIG. 5A is a cross-sectional view taken along the lines 5A in FIG. 5.

Referring to FIG. 5 and FIG. 5A, a muffler assembly 100 including an orifice tube 102 according to a fourth embodiment of this disclosure, is provided. The orifice tube 102 includes an inlet wall 104 that defines a diameter D1 and an exit wall 108 that defines a second diameter D2 less than the diameter D1. The inlet wall 104 is connected to a connection wall 106 by a radius $R_4$. The exit wall 108 extends from a radii $R_5$ and the connection wall 106. The first end 20*a* of the outlet pipe 20 may be attached to the connection wall 106 of the orifice tube 102 by one or more welds or a structural adhesive. The orifice tube 102 may be manufactured by stamping or tube forming in combination with forming the inlet end 104. The geometry of the orifice tube 102 may be a more cost-efficient design compared to the previous embodiments described above.

Figure 6:
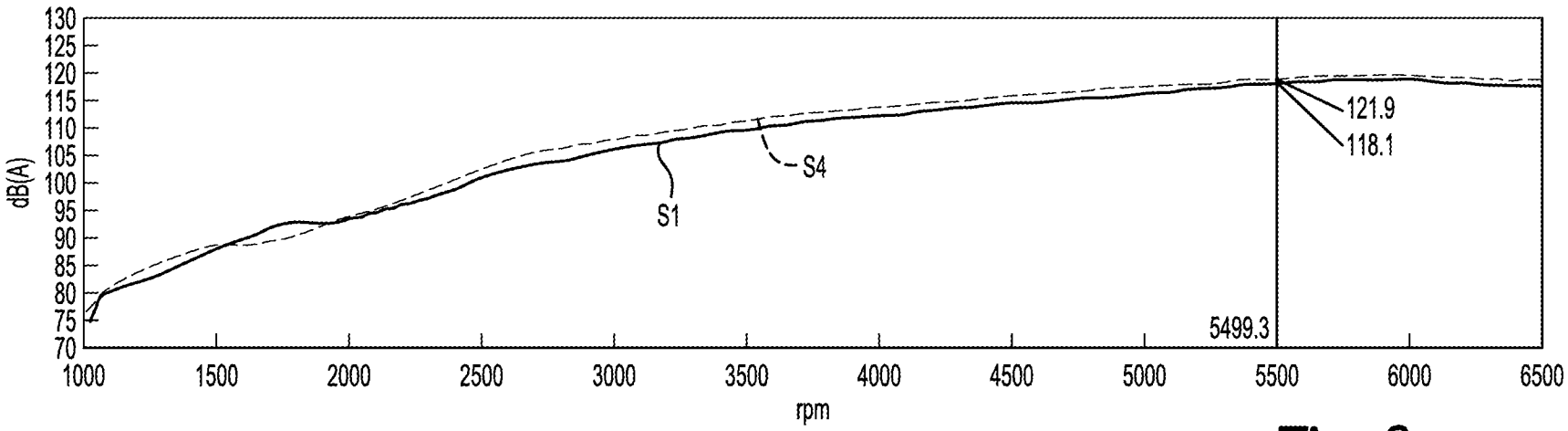
FIG. 6 is graph of sound pressure with respect to a first range of engine speed associated with multiple embodiments of this disclosure.

Referring to FIG. 6, a graph of sound pressure with respect to engine speed associated with multiple embodiments of this disclosure is provided. The air rush noise previously described above is often associated with the sound pressure between 3,500 rpm and 6,500 rpm. The decibel level (dBA) is represented by the vertical axis and engine speed (rpm) is represented by the horizontal axis. Line 51 represents the decibel level (dBA) of the muffler assembly 100 without the orifice tube 102 with respect to engine speed. Line 51 reaches at 118.1 dBA at approximately 5,000 rpm. Line S2 represents the decibel level (dBA) of the muffler assembly 100 and orifice tube 102 of the fourth embodiment illustrated in FIGS. 5-5A. Line S2 reaches at approximately 122 dBA at 5,000 RPM. While the muffler assembly 100 that includes the orifice tube 102 increases the air rush noise by 3 dBA, the lugging moan is decreased as illustrated in FIG. 7.

Figure 7:
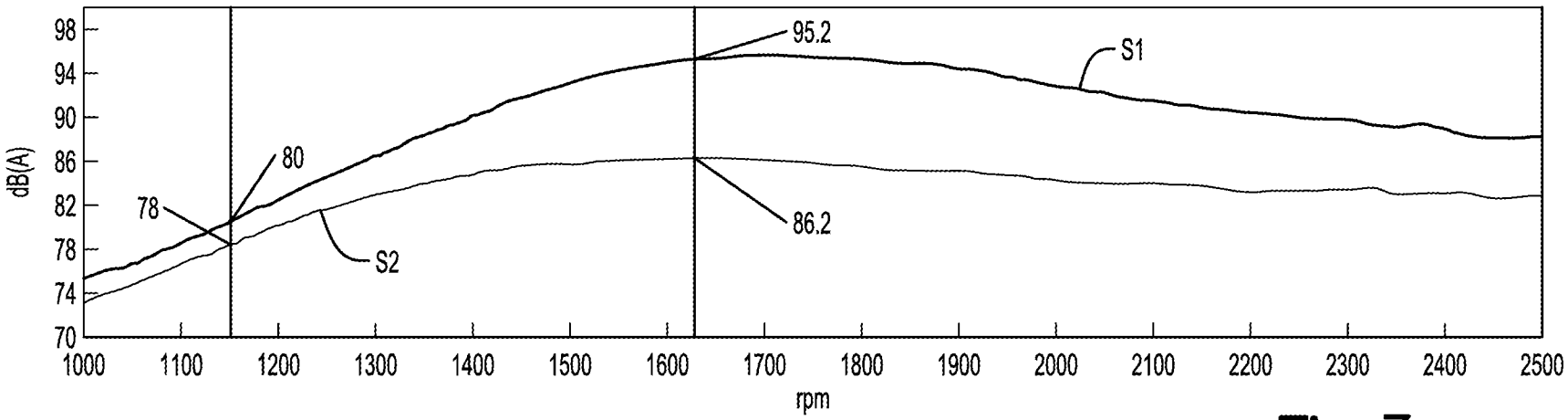
FIG. 7 is graph of sound pressure with respect to a second range of engine speed associated with multiple embodiments of this disclosure.

Referring to FIG. 7, another graph of sound pressure with respect to engine speed associated with multiple embodiments of this disclosure is provided. The lugging noise previously described above is often associated with the sound pressure between 1,100 rpm and 2,000 rpm. The decibel level (dBA) is represented by the vertical axis and engine speed (rpm) is represented by the horizontal axis. Line 51 represents the sound pressure of the muffler assembly 100 without the orifice tube 102 with respect to engine speed. Line 51 reaches 80 dBA at approximately 1,150 rpm and 95.2 dBA at approximately 1,625 rpm. Line S2 represents the decibel level (dBA) of the muffler assembly 100 and orifice tube 102 of fourth embodiment illustrated in FIGS. 5-5A. Line S2 reaches 78 dBA at approximately 1,151 rpm and 86.2 dBA at approximately 1,625 rpm. The addition of the orifice tube 102 decreases the sound pressure by 2 dBA (2.5%) at 1,151 rpm and 9 dBA (11.3%) at 1,625 rpm.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A vehicle exhaust system comprising: a muffler including a casing including a first end and a second end, a baffle disposed in the casing and including a first side, facing the first end, and a second side facing the second end, wherein the first side of the baffle and the first end of the casing defines a first interior portion of the casing, an inlet tube extending through the first end, the baffle, and the second end, and an outlet pipe including a first outlet end, disposed in the first interior portion, and a second outlet end extending past the second end of the casing, and an orifice tube including a tapered body, inserted within the first outlet end of the outlet pipe, an inlet portion, flared from the tapered body, and a distal end portion terminating before the baffle, wherein the orifice tube is configured to attenuate noise of exhaust gas funneling into the outlet pipe from the first interior portion of the casing.

2. The vehicle exhaust system of claim 1, wherein the tapered body includes a medial portion connected to the inlet portion that defines a first diameter and the distal end portion defines a second diameter less than the first such that impedance of the exhaust gas increases as it funnels through the orifice tube to attenuate noise associated with the exhaust gas.

3. The vehicle exhaust system of claim 2, wherein the medial portion and the distal end portion are connected by a tapered wall such that velocity of the exhaust gas increases as it funnels through the orifice tube.

4. The vehicle exhaust system of claim 1, wherein the inlet portion includes an end portion that is folded back towards the tapered body such that it is attached to an outer periphery of the outlet pipe.

5. The vehicle exhaust system of claim 1, wherein the inlet pipe is partially perforated and configured to vent exhaust gas from the inlet pipe to the inlet portion of the orifice tube.

6. The vehicle exhaust system of claim 1, wherein the tapered body includes a proximal portion extending from the inlet portion and wherein the proximal portion is disposed along an inner wall of the outlet pipe.

7. The vehicle exhaust system of claim 1, wherein the noise is associated with engine speed.

8. The vehicle exhaust system of claim 1, wherein the inlet pipe and the outlet pipe are offset from one another and wherein the inlet pipe is positioned parallel to the outlet pipe.

9. A vehicle exhaust system comprising: a muffler including a casing including a first portion and a second portion; a baffle disposed in the casing and bifurcating the casing to form the first portion and the second portion; an inlet pipe extending through the casing, wherein the inlet pipe includes a perforated section disposed in the first portion of the casing; an outlet pipe including a first end disposed within the first portion of the casing, wherein the outlet pipe is positioned parallel to the inlet pipe and offset from the inlet pipe; a funnel disposed in the first end of the outlet pipe and including an inlet portion, an outlet portion, and a flared portion extending therebetween that is configured to mitigate sound pressure of exhaust gas flowing from the perforated section into the outlet pipe; wherein the inlet portion defines a first diameter and the outlet portion defines a second diameter less than the first such that acceleration of the exhaust gas decreases as it flows through the funnel to attenuate noise associated with the exhaust gas; and wherein outlet pipe defines an inner diameter that is less than the first diameter and greater than the second diameter.

10. The vehicle exhaust system of claim 9, wherein the flared portion is configured to attenuate a noise of the exhaust gas that occurs when the speed of an engine surpasses 3,000 rpm.

11. The vehicle exhaust system of claim 9, wherein the inlet portion and the outlet portion cooperate to attenuate a noise of the exhaust gas that occurs when engine speed is between 1,000 rpm and 3,000 rpm.

* * * * *